United States Patent [19]

Smith

[11] 3,990,367

[45] Nov. 9, 1976

[54] INJECTION-MOLDING APPARATUS FOR ATTACHING END FITTINGS TO DETONATING CORDS

[75] Inventor: Allan Howard Smith, San Jose, Calif.

[73] Assignee: The United States of America as represented by the Secretary of the Navy, Washington, D.C.

[22] Filed: June 16, 1975

[21] Appl. No.: 587,173

[52] U.S. Cl. ..... 102/70 R; 102/27 R; 264/3 R; 86/1 R

[51] Int. Cl.[2] ..... F42C 19/02

[58] Field of Search ..... 264/3 R, 262; 102/27 R, 102/70; 86/1

[56] References Cited

UNITED STATES PATENTS 3,238,873 3/1966 Allen ..... 102/27 R 3,893,395 7/1975 Kilmer ..... 102/27 R

*Primary Examiner*—Samuel W. Engle
*Assistant Examiner*—David Leland
*Attorney, Agent, or Firm*—Richard S. Sciascia; Paul N. Critchlow

[57] ABSTRACT

A typical end fitting arrangement includes a sleeve-like bearing member receiving an end of the explosive cord and a coupling member, such as a threaded nut, slipped axially over the cord into a fixed position relative to the sleeve. To securely bind together the cord and the sleeve, a void is provided radially inwardly of the nut and a thermosetting material is directly injected into the void to flow over and around the components. Upon hardening, all components are locked together as an integral body. The injected material further provides a significantly-improved, hermetic seal. Special thermosetting materials having short glass fiber fillers are used to assure load-bearing strength.

8 Claims, 2 Drawing Figures bears when the nut is in its illustrated fixed and assembled disposition. Additionally, ferrule 12 is formed with an elongate sleeve-like portion 17 sized to receive cord 1. In use, cord 1 is threaded into the end fitting so as to place its explosive core portion in direct contact with the explosive in booster 9 and the entire arrangement then is mounted in operative disposition by threading nut 13 into a mating receptacle (not shown).

Although not considered to be a part of the present invention, a special technique preferably is employed to assure intimate and sealed contact between explosive 3 of the cord and the explosive material of booster cup 9. In particular, the seal is provided by employing a special welding technique. Initially, a portion of explosive 3 at the end of confined detonating cord 1 is removed from the metal sheath so that wall portions 18 of the sheath can be expanded and formed against flared surfaces 19 of the bearing sleeve. A welding flange then is formed over the end of the tube and ultrasonic ring welding used to provide a weld 20. Next, the cavity inside sheath 4 is filled with an explosive material that is pressed into intimate contact with the explosive of the core. Finally, the explosive charge cup is placed over the end of the sleeve and secured firmly by an ultrasonic weld 21. Other welding processes, such as projection resistance welding and TIG (tungsten inert gas), also can be employed to provide weld 21. Further, cold welding procedures which employ pressure to physically bind the metal components one to the other have been effectively used and in some respects, are preferred to the ultrasonic welding. The principle advantage of these welding techniques are that a excellent hermetic seal as well as a sound structural weld is provided. The more conventional brazing techniques involve temperature problems which are avoided.

As already indicated, one of the features of the present invention is that the detonating cord is securely and integrally bound to the end fitting by providing a particular void into which a special thermosetting material directly is injected. In the FIG. 1 arrangement which employs the multi-layered cord, the void is provided by stripping back each of layers of the cord and, preferably, the stripping is progressively-stepped in the manner shown in the drawing. In other words, the plastic, fiberglass and wire braid layers of the cord are stripped away from metal sheath 4 of the core of the cord so that, in an assembled position of the end fitting, a relatively large void is formed radially interiorly of a substantial length of sleeve 17. Also, sleeve 17 is formed with a plurality of slots or openings 22–26 one or more of which may be employed as entry ports for injecting the thermosetting, molding compound. These slots, as may be noted in FIG. 1, lie radially inwardly of nut 13 when the nut is in its assembled disposition so that, in effect, the void for the thermosetting material includes both the space provided by the stripping procedure as well as the slots themselves.

To permit the thermosetting material to be introduced into the void nut 13 initially must be backed off from its assembled position. The thermosetting material then can be introduced through, for example, slot 22 using an injection temperature of about 240° F to 350° F and an injection pressures of about 500 to 5000 psi. Also, special thermosetting materials are used, these materials generally being resins or other molding compounds which include a filler of short glass fibers or other functionally-equivalent types of fillers. For example, the materials used may include diallyl phthalate resins filled with short glass fibers, epoxies filled with short glass fibers or phenolic molding compounds also having short glass fibers. Other materials are contemplated providing they are capable of providing the requisite load-bearing strength. In this regard, it will be appreciated that the thermosetting material completely fills the void which extends axially from an end wall of radially enlarged portion 14 of the sleeve to the ends of the stripped multi-layer coverings of the cord. Also, the material when injected flows over and around the components of the cord as well as into the interstices of the cord layers which, as indicated, usually are formed of a woven material. As a further important consideration it is to be noted that the thermosetting fills all of the slots 22–26 so as to provide secure locking projections that are integral with the remainder of the material to prevent slippage of the cord relative to the sleeve and vice versa. In other words, the integral bond created by the thermosetting material, in addition to providing the desired hermetic seal, also becomes a load-bearing member which should have a relatively high tensile strength capable of resisting the tendency for the end fitting components and the cord to pull apart.

The short glass fiber filler of the thermosetting material achieves this desirable high tensile and it is for this reason that its use is preferred. For example, a thermosetting compound without such a filler might have a tensile of 1000–2000 psi while a thermosetting material using the short glass fibers may achieve a tensile of 10,000 psi or more. The thermosetting materials employed for the bond have been provided by Plaskon Thermoset Company and are known as Plaskon Phenol Molding Compound 8000 or 8010 and 8020. These materials are phenolic materials using short glass fiber fillers which is a term well known in the trade. Other fillers which are not as appropriate are the long glass fibers and the so-called 'flake' fillers. Obviously, materials may vary somewhat depending upon the purposes to be achieved. However, the short glass fibers are preferred in all situations where tensile strength is one of the criteria.

After the void or cavity provided by the stripping procedure and by the formation of the slots is completely filled with the thermosetting material, the material, of course, is permitted to harden. Nut 13 then is moved into its assembled, fixed position against radial portion 14 of the metal sleeve and the entire unit secured in its receptacle by threading the nut into the receptacle. The hermetic seal provided by the thermosetting material is, as already indicated, an important improvement in that it materially reduces the leakage rate and thus protects and prolongs the life of the fitting. For example, the leakage rate may be reduced from $1 \times 10^{-3}$ for crimping to $1 \times 10^{-7}$ for the present thermosetting materials. The arrangement also effectively contains the detonation products both of the booster and the cord and, in this regard, the particular arrangement of sleeve 12 and nut 13 improves the confinement of the detonation particularly around the junctures of the components. The sleeve-like extension of bearing sleeve 17 is helpful both as a bearing member and as a detonation transition aid.

The arrangement illustrated in FIG. 2 employs the same principles which already have been discussed with reference to FIG. 1. Thus, FIG. 2 primarily illustrates a manner in which the present principles can be adapted for other cord types and end-fitting arrange-

INJECTION-MOLDING APPARATUS FOR ATTACHING END FITTINGS TO DETONATING CORDS

BACKGROUND OF THE INVENTION

The present invention relates to explosive cords and, in particular, to methods for securing the end portions of such cords to booster-bearing end fittings.

End fittings of the type under consideration are widely used to couple the ends of a length of explosive cord to boosters so that a shock wave propagating through the cord can detonate the boosters to initiate the detonation of a main explosive charge or to perform some other comparable function. A wide variety of end fitting arrangements are used and, of course, various types of explosive cords are employed depending upon the particular function which they are intended to serve. However, most end fittings use a sleeve-like bearing member for receiving an end of the cord and providing a relatively-rigid support through which the explosive core of the cord is communicated with the booster. Also, most fittings use some sort of a coupling member, such as a coupling nut, that fits over the sleeve-like bearing member and itself is adapted to be threaded into a mating receptacle.

The explosive cords, in turn, may include such well-known types as the so-called confined detonating fuze, (CDF) which may or may not be wire braided. Such a CDF generally is formed with a metal-sheathed, explosive core portion and a plurality of external sheathing layers formed of a variety of materials such as plastic, fiberglass and the wire braid. Conventionally, these materials are in a woven form having small interstices provided in the weave. Another type of cord is the shielded mild detonating cord (SMDC) which again employs the metal-sheathed explosive core portion. However, instead of being multi-layered, the core is protected by a metal tube which is spaced from the core portion. In addition to its protective function, the tube confines the detonation products.

As subsequently will be appreciated, the present invention specifically contemplates the attachment of either of these general types of explosive cords to end fittings. Additionally, as will be recognized, the present principles readily can be adapted to most if not all end fitting and cord arrangements. It also should be noted that the terms 'cord' and 'fuze' presently are considered as functional equivalents.

In providing any end fitting, it obviously is necessary to tightly secure the sleeve-portion of the fitting to the cord so that, when the coupling nut is securely in its mating receptacle, the entire arrangement will be tightly bound together as an integral unit. Further, since air or moisture obviously affects propagation of the shock wave, as well as detonation of the booster, it is most desirable to provide end fitting arrangements which are hermetically sealed. Although these purposes, of course, have been recognized, as far as is known the techniques for securing the end fittings have been limited to such expedients as the mechanical crimping together of the end-fitting components or the use of various potting or adhesive materials. Mechanical crimping, when used by itself, provides a rather questionable and unreliable attachment and it does not provide the requisite hermetic seal. Consequently, many fittings combine both the crimping technique and a potting technique in which a resin is introduced usually for the purpose of binding the exterior surfaces of the cord or the bearing sleeve to the member. However, the binding action achieved by the relatively thin layer of resin is itself rather weak. Further since it attempts to bind the outer surface of the cord to the fitting, there is no assurance that the various components of the cord itself may slip one on the other.

It is therefore an object of the present invention to secure an explosive cord end fitting in such a manner that the components of both the cord and the fitting are integrally bound and locked together in an unusually strong, load-bearing manner as well as a manner which significantly improves the hermetic sealing of the bond.

A further object is to adapt the present principles to a wide variety of explosive cord end fittings.

In general, the objects of the invention are accomplished by providing a void disposed radially inwardly of the coupling member of the fitting and extending from substantially the plane of the interior bore of the coupling member radially inwardly to the sheathing of the explosive core portion of the cord. A thermosetting material which employs a strengthening filler, such as short glass fibers, is directly injected into this void to flow in and around the cord components and integrally bind the components to the bearing sleeve of the fitting. The injection of the materials is accomplished with the coupling member withdrawn from its assembled position so as to expose the void and, of course, the coupling member then is moved axially into its fixed position relative to the sleeve and other fitting components. The void is made as large as possible to provide maximum binding strength. Some means, however, should be provided to restrict the axial length of the void so that the injected material can solidly pack itself into the void. A part of the void is provided by entrance slots or openings through which the material is injected. Preferably, a plurality of slots is employed and the injected material permitted to flow into all of the slots for the purpose of providing locking projections such as will be described.

BRIEF DESCRIPTION OF THE DRAWINGS

The present invention is illustrated in the accompanying drawings of which.

DETAILED DESCRIPTION OF THE INVENTION

Figure 1:
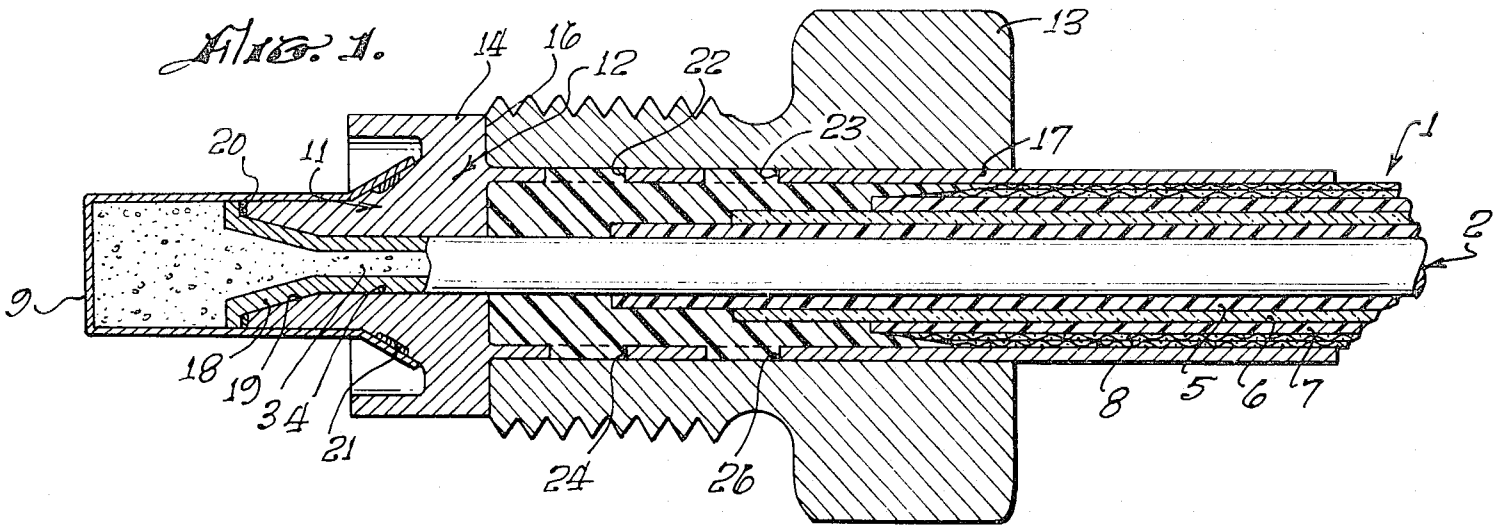
FIG. 1 illustrates the principles of the invention applied to a multi-layered CDF.

Referring to FIG. 1, explosive cord 1 is a multi-braided type of cord generally known as a confined detonating fuze (CDF) which may or may not include exterior wire braid layers. As shown, it includes a central, axially-extending core portion 2 formed of an explosive 3, such as PETN, protectively surrounded by a metal or plastic sheath 4. Surrounding core portion 2 are a plurality of protective layers including a plastic layer 5, a fiberglass layer 6, another plastic layer 7 and an exterior wire braid layer 8. The obvious function of cord 1 is to propagate a shock wave for the purpose of detonating a booster charge carried in a booster cup 9 which, in turn, is carried by an end fitting arragement 11.

Figure 2:
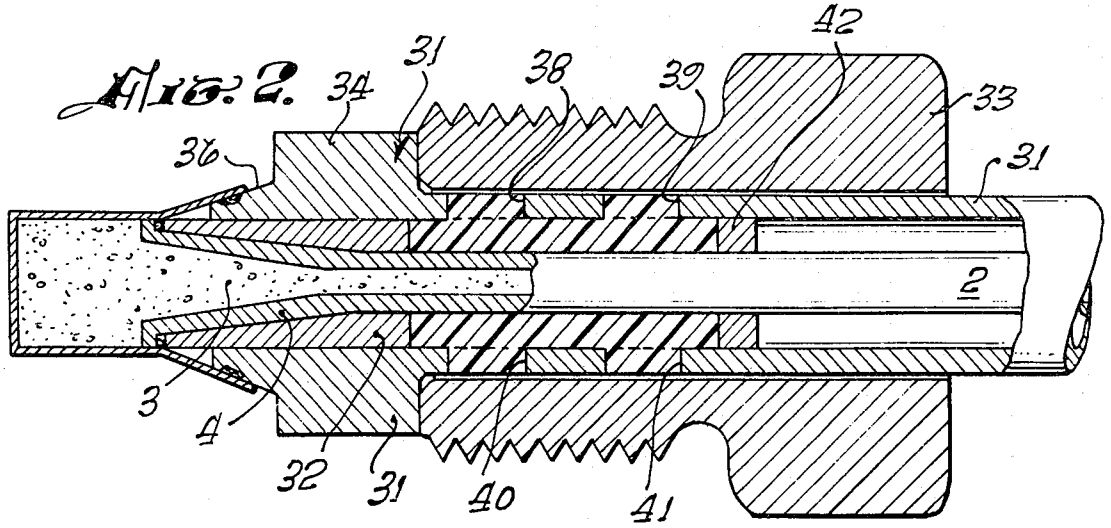
FIG. 2 illustrates the principles applied to a shielded mild detonating cord (SMDC).

End fitting 11, in turn, includes sleeve-like bearing member or ferrule 12 and a coupling nut 13. Ferrule 12, as shown, has its left-hand end portion 14 radially enlarged to provide a flange 16 against which nut 13 ments. In particular, FIG. 2 shows the principles adapted to a so-called shielded mild detonating cord (SMDC) having an explosive core portion 2 core member formed of an explosive 3 surrounded by a metal sheath 4. However, in place of the multi-layered arrangement of FIG. 1, the SMDC employs a metal tube or sheath member 31 radially spaced from core portion 2 so that the cord itself provides a void between metal tube 31 and core 2.

The end fitting for such a shielded cord is similar to that shown in FIG. 1 to the extent that it also uses a metal sleeve 32 and a coupling nut 33. In addition, as already indicated, a booster cup 34 is secured to the end of the core portion 2 of the cord preferably by the welding techniques that have been described.

One of the principle differences of the present arrangement is that sleeve 32 is a relative short member which lies radially interiorly of metal tube 31 of the cord itself. In particular, the left-hand end of metal tube 31 of the cord is upset to provide a radially-enlarged portion 34 against which nut 33 bears when assembled and, in contrast to the FIG. 1 arrangement, the booster cup is welded to surfaces 36 of this upset end portion.

To achieve the injection of the thermosetting material, slots 38–41 are provided in metal tube 31 of the cord rather than being provided in the sleeve as was the case in the FIG. 1 arrangement. With nut 33 backed off to expose one or more of entrance slots 38–41, the thermosetting material is injected into one of the slots to completely fill the void between core 2 and tube 31 of the cord. However, in this particular instance, it is desirable to restrain the flow of the thermosetting material and, for this purpose, a circular plug 42 can be securely lodged to fill the space between the core and its metal tube or sheath. A tight frictional fitting of the plug is all that is required to restrain the flow of the thermosetting material axially along the cord. Further, as in the FIG. 1 arrangement, the thermosetting material is permitted to fill all of the slots to provide the integral lock which prevents slippage. This lock, of course, is provided by the portions of the thermosetting material which project into the slots and, again, the material preferably includes the filler materials of the FIG. 1 arrangement. In principle, the FIG. 2 arrangement is the same as FIG. 1 in that both arrangements include a relatively large void as well as a number of slots into which the thermosetting material is injected to provide the requisite structural strength and the desired hermetic seal. Obviously, other special types of detonating cords or fuzes can be securely bonded to end fitting components in comparable manners to achieve the same results. In fact, many other shapes and configurations of individual component part arrangements are contemplated providing the overall arrangement permits the formation of the present void or cavity as well as the entrance slots which, when filled with the special thermosetting material, provide the desired structural strength and hermetic seal.

Obviously many modifications and variations of the present invention are possible in the light of the above teachings. It is therefore to be understood that within the scope of the appended claims the invention may be practiced otherwise than as specifically described.

I claim:

1. End fitting apparatus for securing an end portion of a detonating cord having a shielded explosive core portion comprising:

a tubular ferrule-like member having a base closely receiving an end length of said core portion and an interior flange extending radially of said core, a rigid tubular sleeve member extending from said interior flange a substantial axial length of said explosive core portion, said sleeve member being spaced radially from said core portion, means carried by said core portion for limiting the axial length of said radial space whereby a closed cavity is formed between said limiting means and said ferrule flange, and a tubular coupling member having a bore closely receiving said sleeve and an end wall flange extending radially of said bore, said coupling member being reciprocably movable axially of said sleeve into operative position wherein its radial flange abuts said ferrule radial flange, said sleeve being formed with a plurality of slots opening into said cavity, said slot openings being provided radially inwardly of said operatively-disposed coupling member whereby the openings can be exposed by coupling member movement and used for injecting a thermosetting material in sufficient amount to completely fill both said cavity and said slot openings for binding and locking said core portion to said sleeve member.

2. The apparatus of claim 1 wherein said structure positively includes said thermosetting material, said material completely filling said cavity and said slots.

3. The apparatus of claim 2 whrein said injected material is a thermosetting molding material compounded with a load-bearing short-fiber filler material.

4. The apparatus of claim 1 wherein said detonating cord is a confined detonating fuse having a plurality of protective sheathing layers and said sleeve bore has its diameter sized for closely receiving the entire cord, each sheathing layer being terminated at a point radially inwardly of said sleeve for providing said limiting means for the axial length of said cavity.

5. The apparatus of claim 4 wherein said terminations are stepped with the longest sheath lying immediately adjacent the core portion.

6. The apparatus of claim 5 wherein said structure positively includes said thermosetting material, said material being injected under pressure and filling said cavity, slots and voids between said stepped sheathing layers.

7. The apparatus of claim 6 wherein said sleeve member is carried by said ferrule-like member.

8. The apparatus of claim 1 wherein said explosive cord is a shielded mild detonating cord (SMDC) having a rigid metal sheath spaced radially of its explosive core portions, said sleeve member being provided by said rigid metal sheath.

* * * * *